US010694298B2

(12) United States Patent
Neumeier et al.

(10) Patent No.: US 10,694,298 B2
(45) Date of Patent: Jun. 23, 2020

(54) HEARING AID

(71) Applicants: Zeev Neumeier, Berkeley, CA (US); W. Leo Hoarty, Morgan Hill, CA (US)

(72) Inventors: Zeev Neumeier, Berkeley, CA (US); W. Leo Hoarty, Morgan Hill, CA (US)

( * ) Notice: Subject to any disclaimer, the term of this patent is extended or adjusted under 35 U.S.C. 154(b) by 0 days.

(21) Appl. No.: 16/660,709

(22) Filed: Oct. 22, 2019

(65) Prior Publication Data

US 2020/0128334 A1 Apr. 23, 2020

Related U.S. Application Data

(60) Provisional application No. 62/748,999, filed on Oct. 22, 2018.

(51) Int. Cl.
*G10L 19/125* (2013.01)
*H04R 25/02* (2006.01)
(Continued)

(52) U.S. Cl.
CPC ..... *H04R 25/02* (2013.01); *G10L 21/0208* (2013.01); *G10L 21/0216* (2013.01);
(Continued)

(58) Field of Classification Search
CPC .... H04R 3/005; H04R 5/033; H04R 2410/05; H04R 2420/07; H04R 25/554; H04R 5/027; H04R 19/00; H04R 19/265; H04R 19/26; H04R 2201/107; H04R 2201/401; H04R 2225/025; H04R 2400/01; H04R 2430/20;
(Continued)

(56) References Cited

U.S. PATENT DOCUMENTS 5,640,490 A * 6/1997 Hansen ..... G10L 15/02 704/254
5,721,783 A * 2/1998 Anderson ..... H04B 1/385 381/328

(Continued)

OTHER PUBLICATIONS

International Search Report related to PCT/US2019/057494 dated Jan. 21, 2020.

(Continued)

*Primary Examiner* — Vijay B Chawan
(74) *Attorney, Agent, or Firm* — Puget Patent; Michael Gibbons

(57) ABSTRACT

A hearing aid configured for detecting and enhancing speech within an audio environment is disclosed. An incoming audio stream is continuously monitored for the presence of speech within the audio stream. A Codebook Excited Linear Prediction ("CELP") encoder analyzes the incoming audio stream and outputs an indication of a presence or absence of human speech within the incoming audio stream. Upon detection of human speech, the hearing aid in real time may: amplify the audio input to make the speech more audible to a wearer; filter non-speech audio through isolation of the speech by passing the output of the CELP encoder directly to a CELP decoder; activate a beam-steering process which makes dominant a microphone closest to a speaker while de-prioritizing input from other microphones of the hearing aid; and/or shape the audio spectrum conveyed by the audio input using a response curve optimized for better clarity of human speech.

20 Claims, 4 Drawing Sheets

(51) Int. Cl.
*H04R 25/00* (2006.01)
*G10L 21/0216* (2013.01)
*G10L 21/0208* (2013.01)

(52) U.S. Cl.
CPC ..... *H04R 25/554* (2013.01); *H04R 25/558* (2013.01); *H04R 2225/43* (2013.01)

(58) Field of Classification Search
CPC ..... H04R 2430/21; H04R 25/505; H04R 25/552; H04R 31/00; H04R 1/1016; H04R 1/1083; H04R 1/406; H04R 2201/023; H04R 2460/01; H04R 2460/07; H04R 25/04; H04R 25/305; H04R 25/353; G10L 2021/02166; G10L 21/0208; G10L 15/02; G10L 15/10; G10L 19/06; G10L 19/09; G10L 19/26; G10L 19/265; G10L 2019/0011; G10L 2021/02168; G10L 21/0216; G10L 21/0272; G10L 25/09; G10L 25/18; G10L 25/93; G06F 3/011; G06F 3/012; G06F 3/013; G06F 3/0482; G06F 3/04842; G06F 3/165; G06F 3/167; H04W 4/027; H04W 4/029; H04W 4/38
USPC ..... 381/56, 316, 57, 92, 23.1, 26, 312, 313, 381/315, 321, 328, 61; 704/270.1, 270, 704/233, 271; 367/117; 375/346; 455/296; 702/190
See application file for complete search history.

(56) References Cited

U.S. PATENT DOCUMENTS 5,751,903 A * 5/1998 Swaminathan ..... G10L 19/06 704/230
6,055,496 A * 4/2000 Heidari ..... G10L 19/12 704/222
8,897,455 B2 * 11/2014 Visser ..... G10L 21/0208 381/26
8,934,587 B2 * 1/2015 Weber ..... G01S 7/023 375/346
9,025,782 B2 * 5/2015 Visser ..... H04R 3/005 381/23.1
10,141,001 B2 * 11/2018 Atti ..... G10L 19/06
10,194,259 B1 * 1/2019 Martin ..... G06F 3/04842
2009/0299742 A1 * 12/2009 Toman ..... G10L 21/0208 704/233
2010/0246867 A1 * 9/2010 Lenhardt ..... H04R 25/353 381/315
2012/0020485 A1 * 1/2012 Visser ..... H04R 3/005 381/57
2012/0177234 A1 * 7/2012 Rank ..... G10L 19/04 381/314
2012/0224456 A1 * 9/2012 Visser ..... G01S 15/86 367/127
2013/0023552 A1 * 1/2013 Zhu ..... A61K 31/4745 514/279
2013/0089227 A1 * 4/2013 Kates ..... H04R 25/453 381/316
2013/0195302 A1 * 8/2013 Meincke ..... G10L 21/02 381/321
2014/0119567 A1 * 5/2014 DeLine ..... B60R 11/0217 381/86
2016/0161595 A1 * 6/2016 Benattar ..... G01S 5/26 367/117
2018/0367884 A1 * 12/2018 Murarka ..... H04R 19/02
2018/0367921 A1 * 12/2018 Murarka ..... H04R 19/02
2019/0028803 A1 * 1/2019 Benattar ..... H04R 1/406

OTHER PUBLICATIONS

Written Opinion of the International Searching Authority related to PCT/US2019/057494 dated.

* cited by examiner

HEARING AID

PRIORITY CLAIM

The present application is related to and/or claims the benefits of the earliest effective priority date and/or the earliest effective filing date of the below-referenced applications, each of which is hereby incorporated by reference in its entirety, to the extent such subject matter is not inconsistent herewith, as if fully set forth herein:

(1) this application constitutes a non-provisional of United States Provisional Patent Application No. 62/748,999, entitled SYSTEMS AND METHODS FOR AN IMPROVED HEARING AID BY DIFFERENTIATING AND ENHANCING VOICE INFORMATION, naming Zeev Neumeier and W. Leo Hoarty as the inventors, filed Oct. 22, 2018, which is currently an application of which a currently co-pending application is entitled to the benefit of the filing date.

FIELD OF THE INVENTION

This invention relates generally to corrective devices for hearing loss treatment and mitigation and, more specifically, to hearing aids.

BACKGROUND OF THE INVENTION

Technological advances in electronically encoding and decoding human speech, among other innovations, provide new opportunities for improvements in corrective devices for hearing loss treatment and mitigation such as hearing aids.

BRIEF DESCRIPTION OF THE DRAWINGS

Certain embodiments of the present invention are described in detail below with reference to the following drawings.

DETAILED DESCRIPTION

Specific details of certain embodiments of the invention are set forth in the following description and in the figures to provide a thorough understanding of such embodiments. The present invention may have additional embodiments, may be practiced without one or more of the details described for any particular described embodiment, or may have any detail described for one particular embodiment practiced with any other detail described for another embodiment.

Importantly, a grouping of inventive aspects in any particular "embodiment" within this detailed description, and/or a grouping of limitations in the claims presented herein, is not intended to be a limiting disclosure of those particular aspects and/or limitations to that particular embodiment and/or claim. The inventive entity presenting this disclosure fully intends that any disclosed aspect of any embodiment in the detailed description and/or any claim limitation ever presented relative to the instant disclosure and/or any continuing application claiming priority from the instant application (e.g. continuation, continuation-in-part, and/or divisional applications) may be practiced with any other disclosed aspect of any embodiment in the detailed description and/or any claim limitation. Claimed combinations which draw from different embodiments and/or originally-presented claims are fully within the possession of the inventive entity at the time the instant disclosure is being filed. Any future claim comprising any combination of limitations, each such limitation being herein disclosed and therefore having support in the original claims or in the specification as originally filed (or that of any continuing application claiming priority from the instant application), is possessed by the inventive entity at present irrespective of whether such combination is described in the instant specification because all such combinations are viewed by the inventive entity as currently operable without undue experimentation given the disclosure herein and therefore that any such future claim would not represent new matter.

Figure 1:
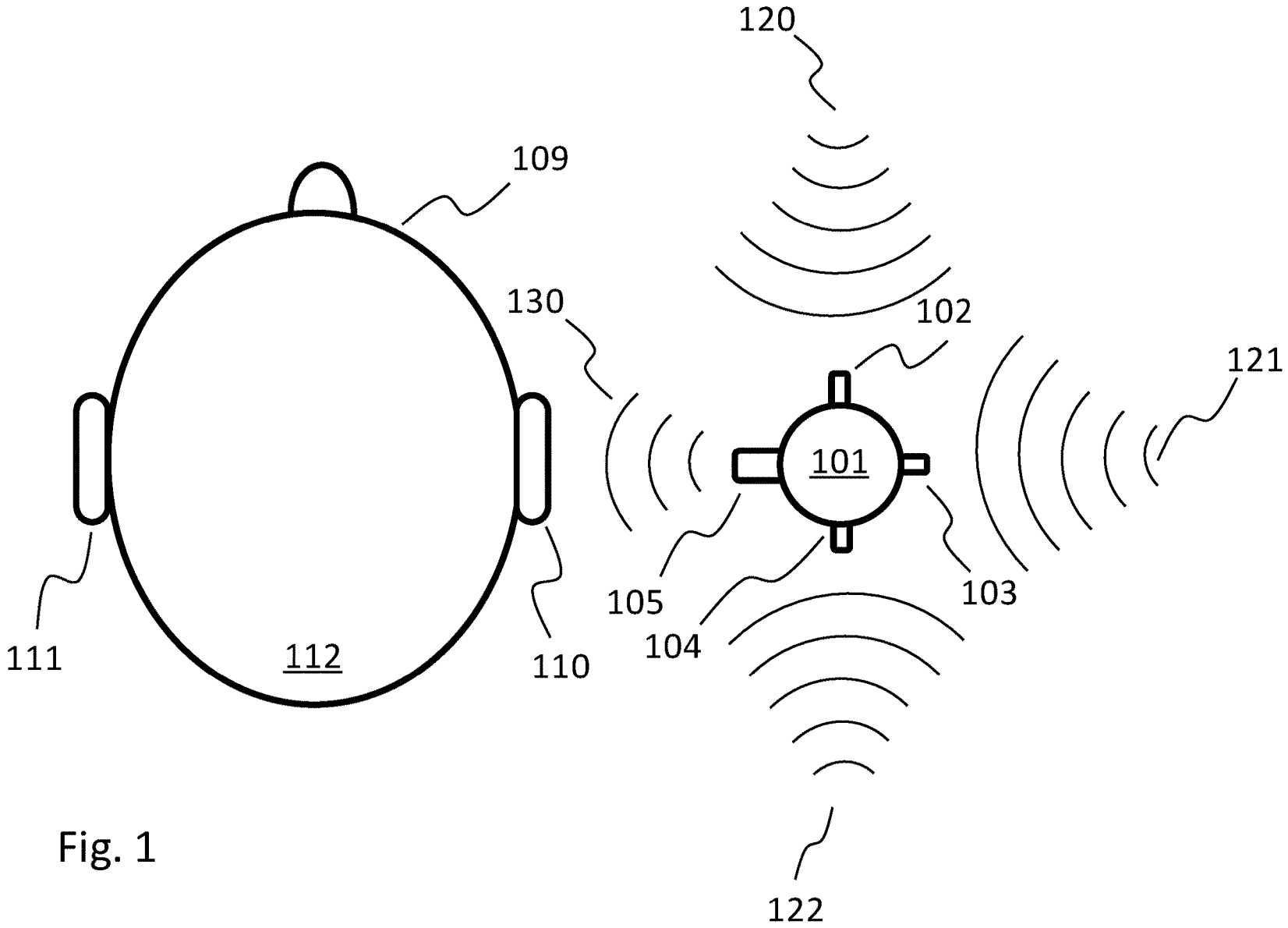
FIG. 1 is a top environmental view depicting a hearing aid and a wearer of the hearing aid within an auditory environment.

FIG. 1 is a top environmental view depicting a hearing aid and a wearer of the hearing aid within an auditory environment. Hearing aid wearer 109 is shown, including the top of the wearer's head 112, the top of the wearers right ear 110, and the top of the wearer's left ear 111. A hearing aid 101 having multiple microphone elements 102, 103, and 104 and speaker element 105 is shown. It is noted that the rendering of hearing aid 101 in FIG. 1 is not intended to depict a physical form for the hearing aid disclosed herein. The rendering is shown in block diagram form and illustrates that multiple microphone elements may be implemented within hearing aid 101 in order to process sound being emitted from various directions such as sound waves 120, 121, and 122. Subsequent to processing by hearing aid 101, a processed audio signal 130 that bears sound information for hearing by the wearer is emitted by speaker element 105 which is proximate to the wearer's ear canal. The environmental view shows a single hearing aid for a single ear which may be worn in either the left or right ear. In some embodiments, dual hearing aids, one for each ear, are implemented for improved hearing ability.

Figure 2:
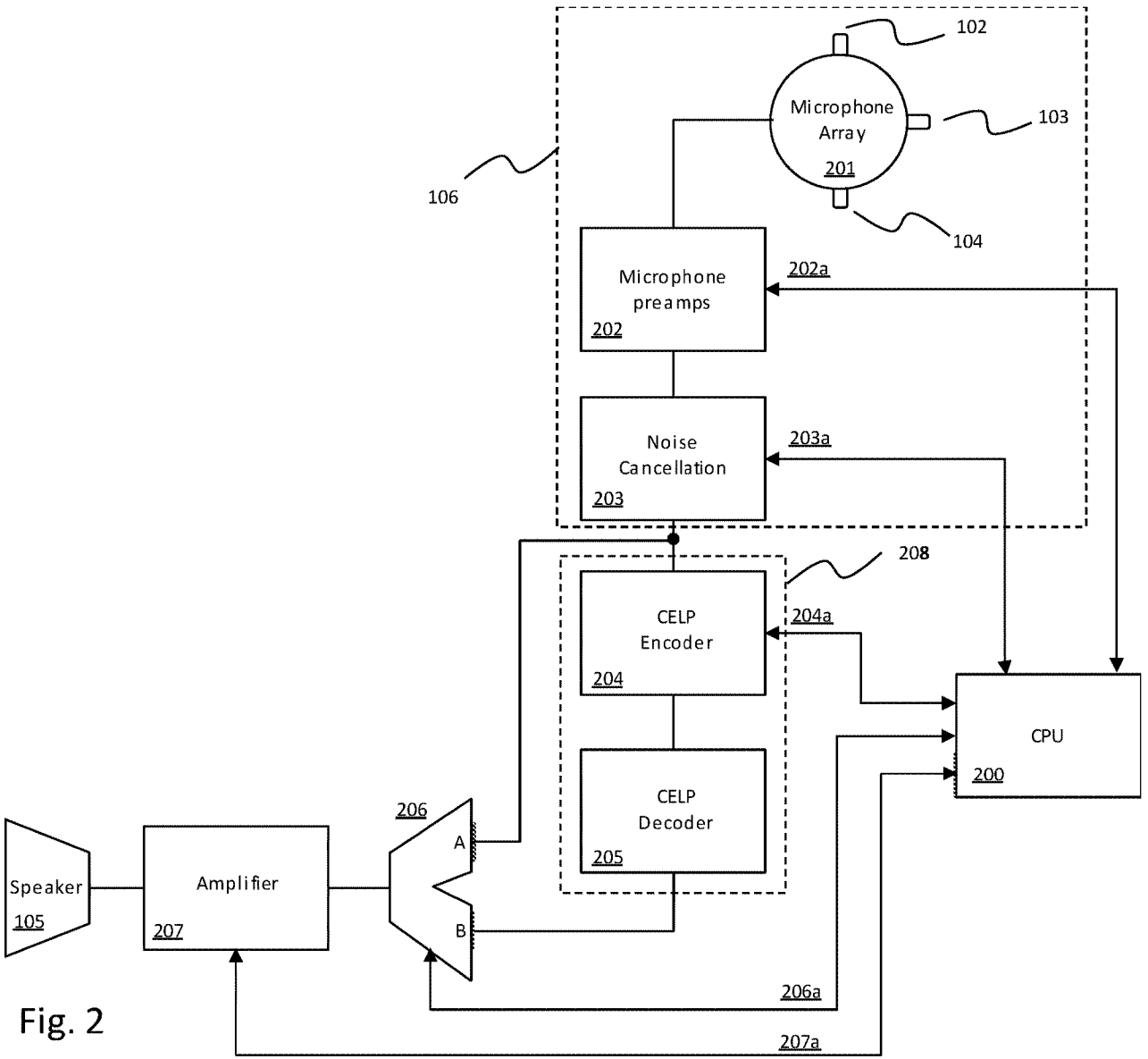
FIG. 2 is a block diagram of a hearing aid.

FIG. 2 is a block diagram of a hearing aid. The hearing aid may include an audio pickup module 106, a speech modeling module 208, an amplifier module 207, and a speaker element 105. Audio pickup module 106 may include microphone array 201 of which microphones 102, 103, and 104 may be a part. The audio pickup module may include one or more microphone preamps 202 and a noise cancellation module 203. A central processing unit ("CPU") 200 is coupled with the microphone preamps via control line 202*a* and with noise cancellation module via control line 203*a*. The speech modeling module 203 may include a Codebook Excited Linear Prediction ("CELP") speech modeling module 204 which is capable of encoding audio signals received from the audio pickup module. The speech modeling module 203 also includes a CELP decoder 205. The CELP encoder 204 is coupled with the CPU 200 via control line 204*a*. A switching element 206 selects between audio passing from the audio pickup module 106 or the speech modeling module 208. The switching element 206 is coupled with the CPU 200 via control line 206*a*. The switching element passes data to amplifier module 207 for auditory output from the hearing aid through speaker element 105. The amplifier module 207 is coupled with the CPU 200 via control line 207*a*.

The components of the hearing aid are operable to detect human speech within audio that is sensed by the device and amplify it for hearing by the wearer. The CELP encoding and decoding process acts as a filter to not only indicate that speech is present within the audio that is sensed by the device, but also to extract the speech audio and separate it from background audio surrounding a person who is speaking to the wearer. The human speech detection is accomplished by the CELP encoder 204. Human speech present within the incoming audio is indicated by a mean square error (MSE) signal generated by the CELP encoder 204. In some embodiments, a value represented by the MSE signal is inversely proportional to an amount of speech detected in the audio received via the audio pickup module. The MSE signal may be routed to the CPU 200 via the control line 204*a*. The CPU 200 can control the switching element 206 via control line 206*a* so as to convey audio from the CELP decoder 205 when the MSE signal indicates that human speech is present and to convey audio directly from the audio pickup module 106 at all other times. Additionally, the CPU 200 can control the amplifier module 207 via control line 207*a* to amplify the audio output to the speaker element 105 when the MSE signal indicates that human speech is present. The result of the CELP encoding and decoding means that the audio is filtered so that only speech is present, and that speech audio is then amplified. At times when no speech is present (as indicated by the MSE signal), the audio output may remain unmodified or may even be dampened to reduce background noise.

It is known in the field of wireless telecommunications, for example, to model human speech using a CELP encoder and to subsequently decode the resulting data stream using a CELP decoder. It is noted that the aforementioned encoding and decoding occurs in two separate devices, such as two mobile phones being used to conduct a wireless telephone call. Specifically, a first wireless phone being used by a first participant encodes the participant's voice using CELP. The resulting data stream is transmitted via a mobile wireless network such as GSM or LTE. Then, the data stream is decoded by a second wireless phone being used by a second participant so that the second participant can hear the speech of the first participant. The inventors assert that it is not known to perform both CELP encoding and decoding of a sound sample of an audio environment in a single device, and that it is not known to perform CELP encoding and decoding of the sound sample of the audio environment for the benefit of a single user (i.e. without the participation or knowledge of the speaker). The inventors assert that it would not occur to one having ordinary skill in the field of corrective devices for hearing loss treatment and mitigation to process a sound sample of an audio environment through use of the CELP encoding and decoding technique used in other applications such as mobile communications. This is because the ordinary artisan would consider CELP to be an unsuitable choice for an encoding solution in a hearing aid due to CELP's primary goal of minimizing data bandwidth for the purpose of efficient use of a mobile network at a cost of reduced fidelity. Yet, while not known to the ordinary artisan in the field of corrective hearing devices, CELP is in fact specifically advantageous for enhancing speech signals over other types of audio and is therefore well-suited to the instant invention and its particular goal of enhancing speech content.

The MSE signal indicative of a presence of human speech may also be used to shape the audio input sensed by the audio pickup module 106 by differently processing sound inputs received by the various microphones 102, 103, and 104. In one embodiment, audio streams received from each of the microphones 102, 103, and 104 are analyzed in parallel by the CELP encoder 204 for a presence of human speech within the various audio streams. When human speech is detected at one or more of the microphones, as indicated by an MSE signal obtained from the CELP decoder that corresponds to the one or more microphones of interest, the microphones with the least detected human speech are attenuated thereby reducing environmental noise, reverberation, or other interference. When human speech is not detected on any of the microphones, the CPU 200 (in concert with the microphone preamps 202) cause the forward facing microphone 102 to become dominant. Audio picked up by the other microphones 103 and 104 is subtracted by the CPU 200 (in concert with noise cancellation module 203) from audio passed to the speaker element 105, thereby producing a reduction in noise by reducing acoustic interference from the side and behind the wearer. The CPU 200, microphone preamps 202, and microphone elements 102, 103, and 104 thus work in concert to enable beam-steering (or beam-forming) that focuses the overall pickup pattern of the microphones into a narrow beam that automatically centers on the source of the audio of interest. Further, in some embodiments, the audio picked up by the other microphones 103 and 104 is also subtracted from the signal passed to the ongoing CELP encoding and decoding, enabling the CELP processes to occur with more accuracy.

While it may be known in the field of corrective hearing devices to implement multiple microphones and/or to bias an incoming audio sample sensed by a particular one of the multiple microphones, the inventors assert that it is not known in the field of corrective hearing devices to determine which microphone's audio to bias towards or to conduct beam-steering upon the presence of human speech sensed by that microphone as determined by an indication of a CELP encoder that the human speech is in fact present in the audio received via that microphone. As discussed above, the use of the CELP encoder in corrective hearing devices would be an unorthodox choice for an ordinary artisan in the field. Particularly, activating beam-steering and/or making a particular microphone element dominant upon detecting the human speech utilizing the MSE signal from the CELP encoder would not occur to the ordinary artisan for the reason that the CELP process would not be considered to have sufficient quality characteristics due to its optimization for mobile communications networks, not hearing aids. Yet, while not known to the ordinary artisan in the field of corrective hearing devices, CELP is in fact specifically advantageous for processing speech signals over other types of audio and is therefore well-suited to the instant invention and its particular goal of selecting microphone inputs based on where speech is being detected.

Figure 3:
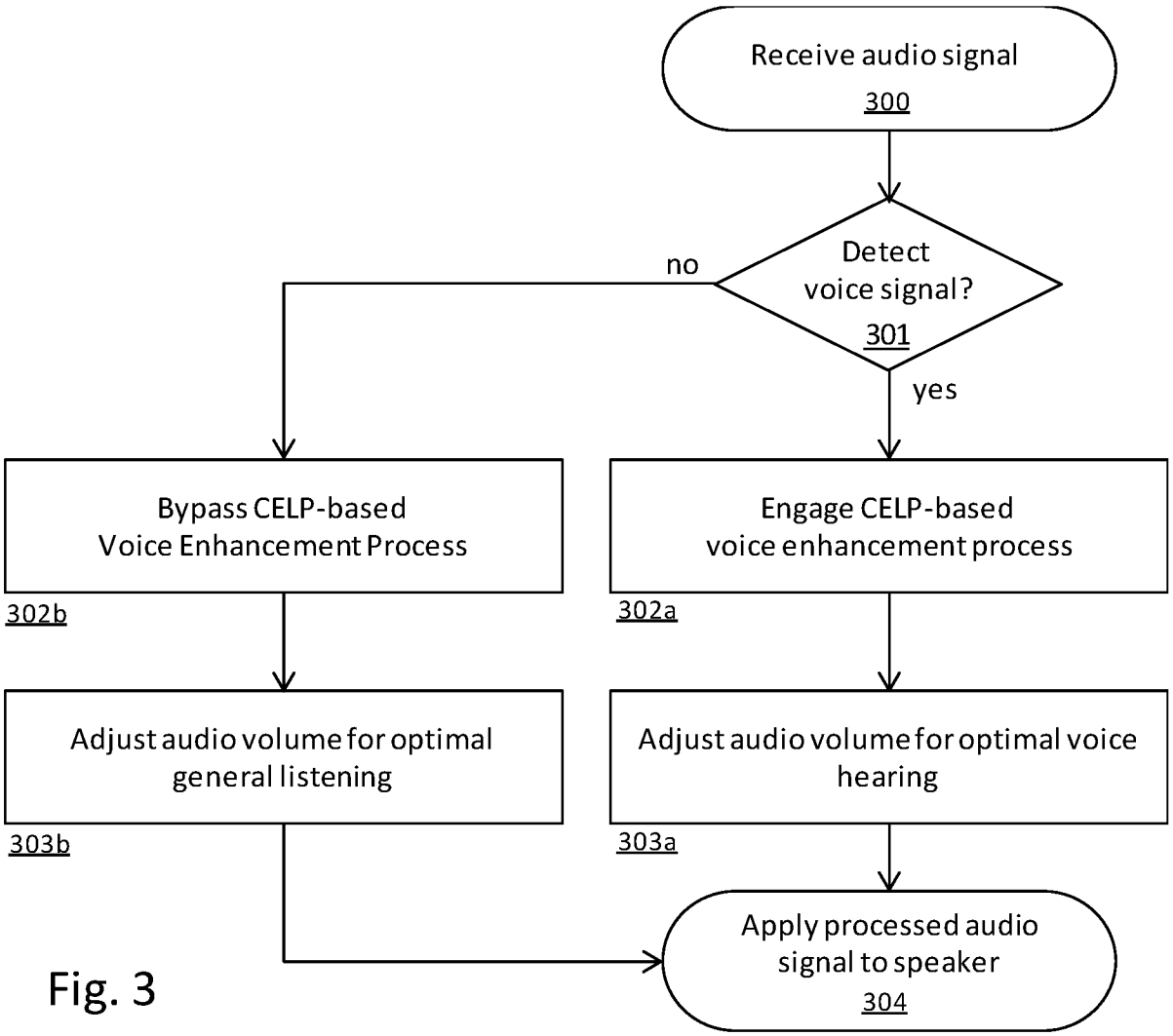
FIG. 3 is a flow diagram depicting an operational flow for a hearing aid.

FIG. 3 is a flow diagram depicting an operational flow for a hearing aid. At 300, receiving an audio signal occurs. In some embodiments, the audio signal is received via an audio pickup module, which may include one or more microphones, one or more microphone preamps, and/or a noise cancellation module. The foregoing elements may be coupled with a central processing unit. At 301, detecting a voice signal within the audio signal occurs. In some embodiments, a voice signal is detected within the audio signal as indicated by a mean square error (MSE) signal output from a CELP encoder that processes the audio signal, the MSE signal indicative of a presence or absence of speech within the audio signal. The MSE signal generated by the CELP encoder may be routed to the central processing unit. If the presence of speech within the audio signal is detected, the operational flow may perform operations 302*a* and 303*a*. If the presence of speech within the audio signal is not detected (i.e. if an absence of speech within the audio signal is detected), the operational flow may perform operations 302*b* and 303*b*.

If the presence of speech within the audio signal is detected, at 302*a*, a voice enhancement process occurs if a voice signal is detected. In some embodiments, voice enhancement process 302*a* may include engaging a CELP-based voice enhancement process to isolate, via the CELP speech modeling (CELP encoding and decoding in succession within the same hearing aid device, for example), the voice signal within the audio signal. The isolation of the speech audio from the audio received via the audio pickup module occurs when the audio received via the audio pickup module 106 is first routed through the CELP encoder 204, and then passed to the CELP decoder 205 for decoding, the decoding resulting in the speech audio. The voice signal is thereby isolated from background audio within the audio signal, and in this way the voice portion and background audio portion of the audio signal are separated into two signals. Alternatively, the background audio portion is filtered out of the audio signal through the CELP encoding/decoding operations, leaving only the voice portion. At 303*a*, adjusting of the audio volume for optimal voice hearing occurs.

If the presence of speech within the audio signal is not detected, at 302*b*, the CELP-based voice enhancement process is bypassed if a voice signal is not detected (i.e. no separation or isolation of speech content from background audio occurs). At 303*b*, adjusting of the audio volume for optimal general listening occurs. At 304, application of the processed audio signal to a speaker element occurs, the processed audio signal including the adjusted audio volume from 303*a* or 303*b*.

Figure 4:
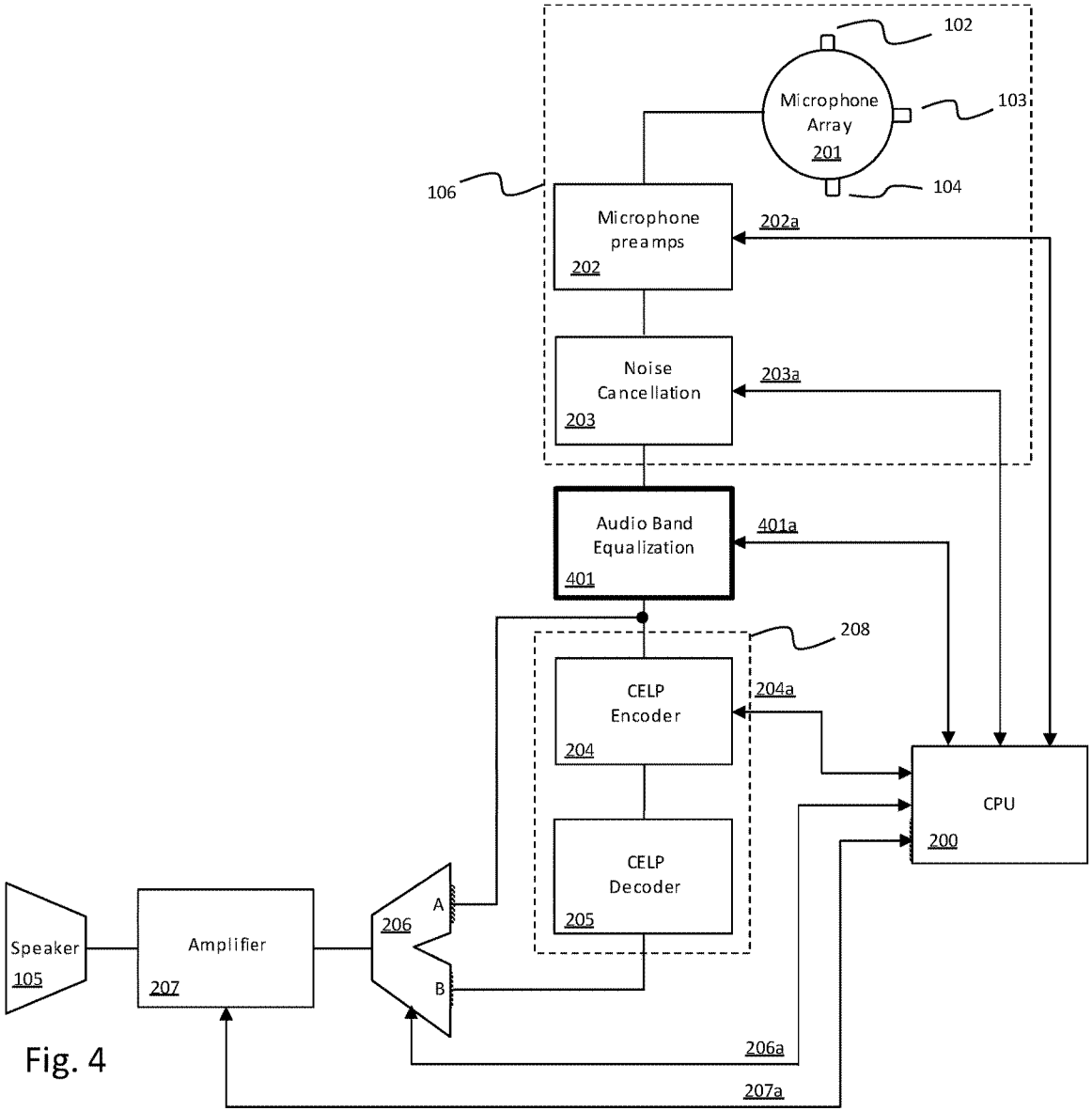
FIG. 4 is a block diagram of an alternative embodiment of a hearing aid.

FIG. 4 is a block diagram of an alternative embodiment of a hearing aid. In some embodiments, a hearing aid may include an audio band equalization module 401 which may be coupled to CPU 200 via control line 401*a*. As audio input is received via the audio pickup module 106 and the presence of speech within the audio input is detected via the speech modeling module 208 (and particularly through CELP encoder 204 providing a signal via control line 204*a* representative of an MSE value indicative of a likelihood of speech being present), the audio band equalization module 401 shapes the audio spectrum corresponding to the audio input. When speech is present in the audio input, a particular response curve beneficial for enhancement of speech may be applied to the audio input by the audio band equalization module 401. When speech is not present, a different response curve beneficial for enhancement of a general listening environment may be applied to the audio input by the audio band equalization module 401. The response curves that are applied by the audio band equalization module 401 may be preset, may be customized for an individual wearer based on measurement of the wearer's hearing capability by a professional audiologist, or may be dynamically generated by the CPU in real-time. While it may be known in the field of corrective hearing devices to adjust or attenuate audio signals within specific frequency bands (i.e. applying a response curve) corresponding to a deficient hearing frequency range in a particular individual, the inventors assert for the reasons given above that it would not occur to the ordinary artisan to apply differing response curves based upon the presence or absence of speech, with that presence or absence being detected via a CELP processing module.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of this subject matter described herein. Furthermore, it is to be understood that the invention is defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.).

While preferred and alternative embodiments of the invention have been illustrated and described, as noted above, many changes can be made without departing from the spirit and scope of the invention. Accordingly, the scope of the invention is not limited by the disclosure of these preferred and alternate embodiments. Instead, the invention should be determined entirely by reference to the claims that follow.

What is claimed is:

1. A hearing aid, comprising:

an audio pickup module;

a speech modeling module, the speech modeling module capable of receiving audio from the audio pickup module, the speech modeling module including at least:

a Codebook Excited Linear Prediction ("CELP") encoder configured for encoding the audio from the audio pickup module; and a CELP decoder configured for providing a speech output based upon data received from the CELP encoder;

an amplifier module;

a speaker element configured for providing hearing aid auditory output from the amplifier module;

a switching element configured for passing selected data to the amplifier module; and a central processing unit, the central processing unit configured for controlling the switching element to select between the audio from the audio pickup module and the speech output provided by the CELP decoder for passing the selected data to the amplifier module, the central processing unit controlling the switching element based upon a presence of speech within the audio from the audio pickup module being signaled by the CELP encoder.

2. The hearing aid of claim 1, wherein the audio pickup module comprises:

a noise cancellation module configured for reducing noise from audio detected at the audio pickup module.

3. The hearing aid of claim 1, further comprising:

an audio band equalization module, the audio band equalization module configured for processing of audio detected at the audio pickup module.

4. The hearing aid of claim 1, wherein the audio pickup module comprises:

at least two microphone elements.

5. The hearing aid of claim 4, further comprising:

a microphone beam-steering module.

6. The hearing aid of claim 1, wherein the audio pickup module comprises:

a microphone preamp module.

7. The hearing aid of claim 1, wherein the speech modeling module comprises:

a Codebook Excited Linear Prediction ("CELP") speech modeling module including at least the CELP encoder and the CELP decoder.

8. The hearing aid of claim 7, wherein the CELP speech modeling module comprises:

a CELP speech modeling module configured for isolating speech audio from background audio using at least one of the CELP encoder or the CELP decoder.

9. The hearing aid of claim 8, wherein the CELP speech modeling module configured for isolating speech audio from background audio using the at least one of the CELP encoder or the CELP decoder comprises:

a CELP speech modeling module configured for isolating speech audio from background audio, including at least:

accepting audio received via the audio pickup module;

isolating the speech audio from the audio received via the audio pickup module; and providing the speech audio to the amplifier module.

10. The hearing aid of claim 9, wherein isolating the speech audio from the audio received via the audio pickup module comprises:

routing the audio received via the audio pickup module through the CELP encoder; and decoding, using the CELP decoder, a stream received from the CELP encoder, the decoding resulting in the speech audio.

11. The hearing aid of claim 10, wherein routing the audio received via the audio pickup module through the CELP encoder comprises:

providing a mean square error ("MSE") value from the CELP encoder, the MSE value being inversely proportional to an amount of speech detected in the audio received via the audio pickup module.

12. The hearing aid of claim 10, wherein decoding, using the CELP decoder, a stream received from the CELP encoder, the decoding resulting in the speech audio comprises:

conveying a stream received from the CELP encoder to the amplifier module when a mean square error ("MSE") value indicated by the CELP encoder is indicative of the stream received from the CELP encoder bearing the speech audio.

13. The hearing aid of claim 1, wherein the amplifier module comprises:

a speech amplifier module configured to increase a volume of audio received via the audio pickup module when the audio received via the audio pickup module bears speech audio.

14. The hearing aid of claim 13, wherein the speech amplifier module configured to increase a volume of audio received via the audio pickup module when the audio received via the audio pickup module bears speech audio comprises:

a speech amplifier module configured to increase a volume of audio received via the audio pickup module when the speech modeling module indicates that the audio received via the audio pickup module bears speech audio.

15. The hearing aid of claim 14, wherein the speech amplifier module configured to increase a volume of audio received via the audio pickup module when the speech modeling module indicates that the audio received via the audio pickup module bears speech audio comprises:

a speech amplifier module configured to increase a volume of audio received via the audio pickup module when a Codebook Excited Linear Prediction ("CELP") speech modeling module indicates that the audio received via the audio pickup module bears speech audio.

16. The hearing aid of claim 15, wherein the speech amplifier module configured to increase a volume of audio received via the audio pickup module when a Codebook Excited Linear Prediction ("CELP") speech modeling module indicates that the audio received via the audio pickup module bears speech audio comprises:

a speech amplifier module configured to increase a volume of audio received via the audio pickup module when a mean square error ("MSE") value indicated by the Codebook Excited Linear Prediction ("CELP") speech modeling module indicates that the audio received via the audio pickup module bears speech audio.

17. The hearing aid of claim 2, wherein the noise cancellation module comprises:

a noise cancellation module configured to:

detect a loudness of an audio input measured from each microphone of a plurality of microphones in the audio pickup module;

determine which microphone is receiving the loudest audio input; and subtracting audio inputs from microphones in the audio pickup module other than the microphone that is receiving the loudest audio input.

18. The hearing aid of claim 3, wherein the audio band equalization module comprises:

an audio band equalization module configured to modify a frequency response curve applied to audio received via the audio pickup module upon a mean square error ("MSE") value indicated by the speech modeling module indicating that the audio received via the audio pickup module bears speech audio, the frequency response curve applied to the audio received via the audio pickup module optimized for hearing of speech and not for hearing of environmental audio.

19. A hearing aid method, comprising:

receiving an audio signal;

detecting, via Codebook Excited Linear Prediction ("CELP") speech modeling, if a voice signal is present within the audio signal;

adjusting an audio volume for optimal voice hearing if the detecting, via the CELP speech modeling, indicates that a voice signal is present within the audio signal; and applying a processed audio signal that includes the adjusted audio volume to a speaker element.

20. A hearing aid method, comprising:

receiving an audio signal;

detecting, via Codebook Excited Linear Prediction ("CELP") speech modeling, if a voice signal is present within the audio signal;

controlling a switching element to pass data selected from the audio signal or the voice signal present within the audio signal; and applying the data passed from the switching element to a speaker element.

* * * * *